US005443717A

United States Patent [19]

Scalliet et al.

[11] Patent Number: 5,443,717

[45] Date of Patent: Aug. 22, 1995

[54] RECYCLE OF WASTE STREAMS

[75] Inventors: Robert M. Scalliet, Houston; Craig A. Koopersmith, Spring, both of Tex.; Walter A. Carter, Baton Rouge, La.

[73] Assignee: Scaltech, Inc., Houston, Tex.

[21] Appl. No.: 6,382

[22] Filed: Jan. 19, 1993

[51] Int. Cl.[6] ..... C10G 9/14; C10G 17/00

[52] U.S. Cl. ..... 208/131; 208/13; 208/50

[58] Field of Search ..... 208/13, 252, 127, 131, 208/85, 48, 50; 210/770, 781, 787

[56] References Cited

U.S. PATENT DOCUMENTS 3,917,564 11/1975 Meyers .
4,666,585 5/1987 Figgins et al. .
4,810,393 3/1989 Guinard ..... 210/712
4,874,505 10/1989 Bartilucci et al. .
4,985,131 1/1991 Lane ..... 208/13
5,009,767 4/1991 Bartilucci et al. ..... 208/85

*Primary Examiner*—Asok Pal
*Assistant Examiner*—Bekir L. Yildirim
*Attorney, Agent, or Firm*—Browning, Bushman, Anderson & Brookhart

[57] ABSTRACT

A process for producing a delayed coker quench stream for use in the quench cycle of a delayed coking process wherein a waste stream containing water, organic compounds and solids is treated to produce a coker feed stream containing from about 5 to about 35% by weight solids, water and less than about 6% by weight mobile organics, the solids having a particle size distribution such that greater than about 70% of the total solids volume comprises solids having a particle size of less than about 15 microns.

10 Claims, 1 Drawing Sheet

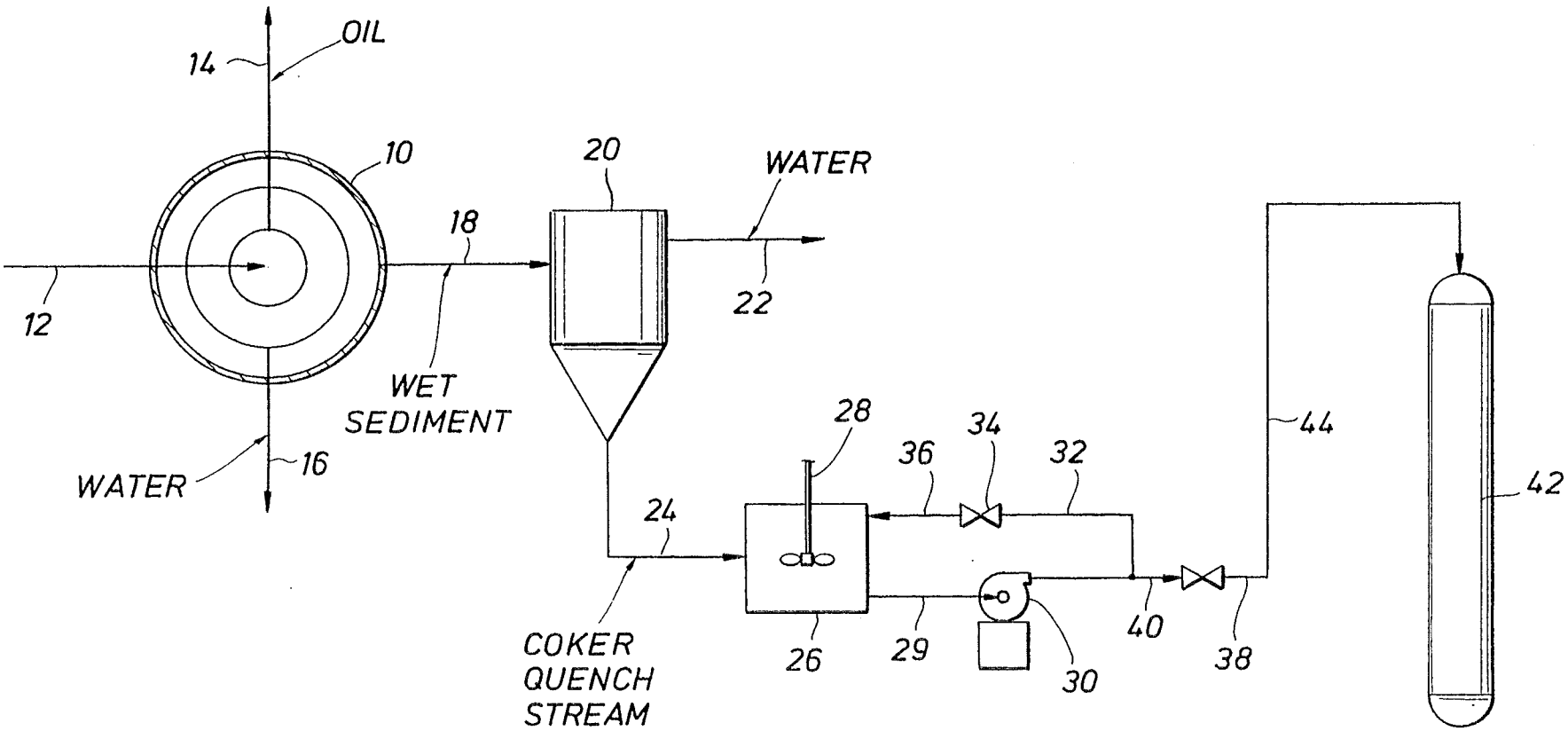
42
44
38
40
32
30
34
36
29
28
26
WATER
22
24
20
COKER
QUENCH
STREAM
18
WET
SEDIMENT
10
OIL
16
14
WATER
12

RECYCLE OF WASTE STREAMS

BACKGROUND OF THE INVENTION

1. Field of the Invention

The present invent;on relates to a process for recycling of waste streams, particularly petroleum waste streams, generated in refinery operations. More particularly, the present invention relates to a delayed coking process employing a feed stream produced from a petroleum waste stream.

2. Description of the Prior Art

Many refineries, chemical plants, waste water treatment plants and other such industrial and municipal facilities generate waste products in the course of their operation. For example, in the refining of petroleum there are produced waste products or streams such as heavy oil sludges, biological sludges from waste water treatment plants, activated sludges, gravity separator bottoms, storage tank bottoms, oil emulsion solids including slop oil emulsion solids and dissolved air flotation (DAF) float from flocculation separation processes, etc. The disposal of these waste products can create difficult and expensive environmental problems primarily because the waste streams are not readily amenable to conversion to more valuable, useful or ecologically innocuous products.

Several methods have been proposed for dealing with the disposal, in an economical and environment;ally acceptable fashion, of waste products such as petroleum refinery sludges and other such waste products. In U.S. Pat. No. 3,917,564 (Meyers), incorporated herein for all purposes, there is a process disclosed in which sludges and other by-products of industrial and municipal activities are added to a delayed coker as an aqueous quench medium during the quench portion of the delayed coking cycle. The combustible solid portions of the by-product become a part of the coke, and the non-combustible solids are distributed throughout the mass of the coke so that the increase in the ash content of the coke is within commercial specifications, especially for fuel grade coke products.

Another proposal for dealing with petroleum sludges is disclosed in U.S. Pat. No. 4,666,585 (Figgins), incorporated herein for all purposes, which discloses a process in which petroleum sludges are recycled by adding them to the feedstock to a delayed coker before the quenching cycle so that the sludge, together with the feed, is subjected to delayed coking. This process has the desirable aspect of subjecting the combustible portion of the sludge to the high coking temperatures so that the conversion either to coke or the distillation of residual hydrocarbon products takes place. However, the presence of water in the sludge tends to lower the coking temperature unless compensation is made for this factor, for example, by increasing the operating temperature of the coking furnace, which in turn may decrease the yield of the more desirable liquid product from the delayed coking process. In addition, the amount of sludge that may be added to the coker feed is limited by the presence of the relatively large amount of water in the sludge. As described in the patent, the amount of sludge is limited to a maximum of 2 weight percent.

Yet another proposal for dealing with petroleum sludges is disclosed in U.S. Pat. No. 4,874,505 (Bartilucci), incorporated herein for all purposes, in which oily sludges and other refinery waste streams are segregated into a high oil content waste that is injected into a delayed coking unit during the coking phase of the cycle and a high water content waste that is injected during the quenching phase of the delayed coking cycle. This process purportedly increases the capacity of the delayed coker to process refinery wastes and sludges and has the potential for improving the quality of the resulting coke obtained from the process. Using this process, refinery sludges can be added at a rate of up to about 2 bbl/ton of coke produced.

U.S. Pat. No. 5,009,767 (Bartilucci, et al.), incorporated herein for all purposes, discloses a process similar to the earlier Bartilucci patent modified by the fact that the high oil content sludge is de-watered prior to being introduced into the delayed coking unit during the coking phase of the cycle.

While the above processes are effective to a certain degree in disposing of waste products such as refinery sludges, in general they suffer from the disadvantages such that, in general, there is a significant loss of valuable oil (organics), which is absorbed in the coke or collected in the blow-down system. Furthermore, with quench cycle injection of raw oil sludges, there is a tendency for oily build-up to occur in the coke drum, and the volatile combustible matter (VCM) levels in the coke are often objectionably high.

SUMMARY OF THE INVENTION

It is therefore an object of the present invention to provide an improved method for disposal of waste products, especially waste products produced during the refining of petroleum.

Another object of the present invention is to provide an improved process for producing delayed petroleum coke utilizing waste products produced during the refining of petroleum.

Still a further object of the present invention is to provide a process that increases the recycling of hazardous waste products in a process that converts such waste products into more valuable, useful or ecologically innocuous products.

Still a further object of the present invention is to provide a process for producing a coker quench stream from a petroleum refinery sludge.

The above and other objects of the present invention will become apparent from the drawing, the description given herein, and the appended claims.

The present invention provides a process for producing delayed petroleum coke wherein a waste stream containing water, organic compounds and solids is treated to produce a delayed coker quench stream containing from about 5 to about 35% by weight solids, water ,and less than about 6% by weight water-insoluble or water-immiscible organic compounds (mobile organics) that can be separated from the coker quench stream using a laboratory centrifuge at 2500 x g at 180° F. for 5 minutes, the solids having a particle size distribution such that there is greater than about 70%, preferably greater than about 80%, of the total solids volume wherein the solids have a particle size of less than about 15 microns. The coker quench stream thus produced is introduced into a coking vessel during quenching of the produced coke.

BRIEF DESCRIPTION OF THE DRAWING

The single Figure is a schematic flow diagram of the process used to treat the waste product to produce the coker quench stream.

DESCRIPTION OF THE PREFERRED EMBODIMENTS

While the process of the present invention will be described with particular emphasis toward treating of waste products produced in the refining of petroleum, it is to be understood that it is not so limited. For example, waste products that are petroleum-like in nature such as those derived from chemical processes, municipal sewerage treatment plants and other such facilities can also be used as waste products that can be treated to produce a coker quench stream that can be used in the process of the present invention. However, the process finds particular application in treating waste products produced during the refining of petroleum since the process enables recycling of components of the waste products into the refinery operation for upgrading to valuable products. In general, the process is applicable to any waste product that contains an "oily component." The term "oily component" is intended to include materials that are organic in nature and is generally a mixture of water-insoluble organic compounds. Such organic components can include hydrocarbons, both aliphatic and aromatic, as well as other organic compounds containing oxygen, nitrogen and sulfur such as ketones, carboxylic acids, aldehydes, ethers, sulfides, amines, etc. Generally, especially in the case of waste products produced in the refining of petroleum, hydrocarbons are the principal components of the organic materials. Without limiting the scope of the process of the present invention, the waste products typically found in refineries that may be treated to produce the coker feed stream include biological sludges from waste water treatment plants, such as activated sludges, and other oily sludges including gravity separator bottoms, storage tank bottoms, oil emulsion solids including slop oil emulsion solids, finely dispersed solids or dissolved air flotation (DAF) float from flocculation separating processes and other oily waste products from refinery operations.

The waste products (streams) that are typically treated according to the process of the present invention are commonly referred to as sludges and are mixtures of water, organic compounds and solids. The sludges can vary widely in composition. For example, such a sludge or waste stream can contain from about 5 to about 30% by weight organic compounds, from about 50 to about 95% by weight water and from about 1 to about 40% by weight solids. The oily component, as noted above, can comprise a myriad of organic compounds ranging from hydrocarbons to other organic compounds mentioned above. The mixture of organic compounds is commonly referred to as oil since, for the most part, they are combustible products (usually primarily hydrocarbons) that are or tend to be insoluble or immiscible in water. The solids in the waste products or streams comprise suspended carbonaceous matter together with varying quantities of non-combustible materials including silt, sand, rust, catalyst fines and other, generally inorganic materials. Sludges of the type that are useful in the process of the present invention are typically produced in the course of refining operations including thermal and catalytic cracking processes and from heat exchanger and storage tank cleaning and in the bottoms of various process units including API separators.

The coker quench stream produced according to the process of the present invention, is intended to refer to a stream that is introduced into the delayed coker during the quench cycle together with the main quench cycle stream generally employed. In the process for producing the coker quench stream, a waste stream (sludge), as described above, is treated, by methods described hereinafter, to produce a delayed coker quench stream containing from about 5 to about 35% by weight, preferably from about 5 to about 20% by weight, solids; less than about 6, preferably less than about 4%, by weight mobile organics hereinafter defined; and the balance water. The desired goal is to minimize the content of the organic compounds (mobile organics) in the coker quench stream, ideally the coker quench stream containing no such organic compounds. The term "mobile organics," as used herein, means those water-insoluble or water-immiscible organic compounds that can be separated from the produced coker quench stream using a laboratory centrifuge at 2500 x g at 180° F. for 5 minutes. The mobile organics are generally organic compounds that either have a relatively low melting point, i.e., less than about 120° C. (and usually are liquid at ambient temperature) and that in many cases can be removed from the waste stream or sludge, for example, by use of a decanter centrifuge operating at 2000 x g such as would frequently be found in a refinery that treats waste streams. Generally speaking, such mobile organics are to be distinguished from solid, carbonaceous materials that will not be separated under the test conditions described above using a laboratory centrifuge and that generally have melting points in excess of 120° C. It will also be understood that the term mobile organics does not include certain organic compounds or substances present in the coker quench stream that may be soluble in methylene chloride but that nonetheless would not be separated as per the laboratory test method noted above. Typically, mobile organics will have a composition in terms of individual components, similar to that described above with respect to the term "oily component," as to waste products or streams. Thus, the mobile organics will usually be found in the organic or oil layer of the waste stream since they are generally water-insoluble or water-immiscible. To produce a desirable coker quench stream, it is necessary that such mobile organics be present in the quench stream in an amount no greater than about 6% by weight, preferably less than 4% by weight, ideally there being as little as possible of such mobile organics in the quench stream. As a practical matter, since economy of operation generally precludes reducing the organic compounds to zero, a coker quench stream containing from about 2 to about 5% by weight of such mobile organics makes a desirable coker quench stream. It will be recognized that the composition of the mobile organics is quite complex and may contain literally hundreds or even thousands of different compounds of the type described above with respect to describing the "oily component" of the waste stream from which the coker quench stream is derived.

The solids that are present in the coker quench stream, as noted above, can comprise both organic and inorganic materials and typically are comprised of suspended carbonaceous matter together with varying quantities of non-combustible materials, including silt, sand, rust, catalyst fines and other inorganic materials.

In general, the solids are those materials contained in the waste stream that are not soluble in either the water phase or the organic phase of the waste stream.

Treatment of the waste streams as per the process of the present invention must be conducted so as to result in attrition of the solid particles such that the mean particle size is reduced to produce solids in the coker quench stream that have a mean particle size of less than about 20 microns, preferably less than about 10 microns. In general, the solids in the waste stream should be treated by an attrition method such that there is essentially greater than about 70%, preferably greater than about 80%, of the total solids volume having a particle size less than about 15 microns. Preferably, the solids will have a particle size distribution that is generally, but not necessarily, Gaussian in nature. Such a distribution of the solids coupled with maintaining the size of the solids in the above-specified particle size range produces a coker quench stream that is less viscous and therefore more pumpable, and that produces a higher quality coke. The amount of solids in the coker quench stream will range from about 5 to about 35% by weight, usually from about 5 to about 20% by weight.

Treating the waste stream to obtain the coker quench stream can be accomplished by numerous different methods. For example, the waste stream can be treated using a common horizontal decanter to separate out the mobile organics from the solids and the water phase after which the solids are further treated in a suitable manner to obtain the desired particle size and particle size distribution characteristics. Alternately, the waste stream can be separated using techniques such as filtration, decantation, extraction, etc., the solids being subjected to size reduction by techniques such as ball mills, hammer mills, roller mills or any type of equipment in which grinding or disintegration of solids can be accomplished.

A particularly desirable, technique for treating the waste streams is to subject the waste stream to separation in what is commonly referred to as a three-phase, vertical disk and nozzle centrifuge (vertical disk centrifuge). It has been found that such centrifuges serve not only to effect separation of the waste stream but also act as attrition devices in the sense that the particle size of the solids is reduced and the desired distribution obtained. Moreover, the attrition mechanism is such that the particle size distribution tends towards being Gaussian in nature. Such centrifuges and processes of using them are disclosed in U.S. Pat. Nos. 4,810,393 and 4,931,176, both of which are incorporated herein by reference for all purposes. Using such vertical centrifuges, it is possible to separate a given waste stream into a water fraction, an organic fraction (containing about 90 to about 100% by weight mobile organics (oil)) and a solids fraction (containing from about 80 to about 98% by weight water), the solids fraction comprising primarily water, a small amount of mobile organics and from about 2 to about 15% by weight solids. If necessary, this solids fraction can then be further processed, as for example by removing water, to increase the solids content and thereby produce the coker quench stream.

Once the coker quench stream has been produced, it can be introduced, together with the primary quench feed, into a coking vessel or drum in the quench cycle.

Reference is now made to the drawing for a description of a preferred method of carrying out the process of the present invention. A vertical disk centrifuge 10, such as described above, receives a waste stream from line 12. The centrifuge 10 separates the waste stream into an organic fraction (oil) that exits centrifuge 10 via line 14, an aqueous fraction (water) that exits centrifuge 10 via line 16 and a solids fraction (wet sediment) in which the solids have undergone attrition that exits centrifuge 10 via line 18. In a typical case, the wet sediment exiting centrifuge 10 via line 18 will comprise, by weight, 80–98% water, less than 2% by weight mobile organics and 3–15% by weight solids.

To reduce the water content of the wet sediment (if necessary), it is fed into a de-watering apparatus 20, which can be any apparatus for separating solids and liquids such as, for example, filtration equipment. Thus, the de-watering apparatus 20 can comprise a filter press, continuous vacuum filters such as drum filters, disk filters, horizontal filters such as table filters, pan filters and belt filters, belt presses, centrifugal separators, etc. The de-watering apparatus 20 can also comprise a simple settling tank that allows the solids to concentrate in a thickened slurry that is removed as desired. Once the desired degree of water removal has been achieved so as to obtain the desired solids content in the wet sediment to produce the coker quench stream, it is removed from de-watering apparatus 20 via line 24, excess water having been removed from de-watering apparatus 20 via line 22.

The coker quench stream is introduced into storage tank 26 equipped with a stirrer 28 to maintain the solids in suspension. Uniformity of the coker quench stream is also maintained by a circulating loop made up of line 29, pump 30, line 32, valve 34 and line 36. Coker quench in storage tank 26 is circulated by pump 30, a valve 38 present in a line 40 leading to coker drum 42 being maintained in the closed position. When it is desired to introduce the coker quench stream into the coke drum 42, valve 34 is closed, valve 38 is opened and pump 30 pumps the coker quench stream out of storage tank 26 and into coker drum 42 via lines 29, 40 and 44, the coker quench stream being introduced into coker drum 42 during the quench cycle.

While not shown, it will be understood that in the usual case, the coker quench stream in storage tank 26 will be admixed with the primary quench feed to coker drum 42 either by admixing the coker quench stream prepared according to the process of the present invention with the primary quench feed in storage tank 26 or by some other technique incorporating the coker quench stream produced per the process of the present invention into the primary quench stream. While in the method described above, the wet sediment exiting centrifuge 10 via line 18 is de-watered in de-watering apparatus 20, such a de-watering step is not always necessary. Frequently, the wet sediment removed from the centrifuge can be used as the coker quench stream without any further processing, i.e., de-watering. In that event, and with reference to the drawing, wet sediment removed via line 18 would be passed directly into storage tank 26 for use as needed, i.e., de-watering apparatus 20 would be bypassed.

The delayed coking process is an established process in the refining industry and is described, for example, in U.S. Pat. Nos. 3,917,564 and 4,666,585 (incorporated herein by reference for all purposes), to which reference is made for a disclosure of the delayed coking process and of its use in sludge recovery. Although one coking drum is shown for simplicity, it will be appreciated and as described in the aforementioned patents, in a conventional delayed coking unit, two or more coke drums are used in sequence with the feed being fed to each drum in turn during the coking phase of the cycle until the drum is substantially full of coke. The feed is then switched to the next coking drum in the sequence while the first drum is stripped of volatile cracking products by the use of steam, after which the coke is quenched during tile quenching phase of the delayed coking cycle and then removed from the coking drum, usually by the use of hydraulic cutting equipment. In the process of the present invention the coker quench stream produced is introduced into the quench phase of the delayed coking cycle and not into the coking phase of the cycle.

To more fully demonstrate the present invention, the following non-limiting examples are presented.

EXAMPLE 1

In a refinery test run, a waste stream containing about 80% by weight water, about 5% by weight solids (55% of the total solids volume having a particle size of less than 15 microns), and about 15% by weight organics was introduced into a Guinard model DC6 vertical disk centrifuge. The wet sediment obtained from the centrifuge contained 84.53% by weight water, 4.84% by weight organics and 10.63% by weight solids. The wet sediment was fed into a settling tank and allowed to produce a thickened slurry containing 82.1% by weight water, 12.3% by weight solids and 5.6% by weight organics. The solids had a mean particle size of about 9 microns and a particle size distribution such that about 82% of the total solids volume had a particle size less than about 15 microns. It was also observed that the particle size distribution was generally normal (Gaussian). The thickened slurry was introduced as a coker quench stream into a typical coking drum during the quench cycle. By using the process, it was found that the coker quench stream volume being introduced into the delayed coking operation was reduced by 60% as compared with the coker quench stream (raw sludge) introduced as per the prior art process disclosed in U.S. Pat. No. 3,917,564. This is significant, for one, since it represents prior recovery of valuable, recyclable oil (organics) that can be recycled to refinery operations for conversion to more valuable products. The process also allows the amount of solids added per unit time to be increased. Further, the duration of addition can be increased as compared with the prior art process. Thus, for example, the solids content of the coker quench stream introduced into the quench cycle has been increased to the point where 12 lbs. of solids are added to each ton of coke as compared to 1 lb. of solids/ton of coke using the above-noted prior art process.

EXAMPLE 2

In another typical refinery operation, the process of Example 1 was essentially repeated except that the wet sediment was not de-watered. The solids in the waste stream fed to the centrifuge had a mean particle size of approximately 29 microns with greater than 30% by volume of the total solids having a particle size of greater than 15 microns. Indeed, the particle size distribution was found to be slotted, i.e., greater than 80% cumulative volume of the solids had a particle size of greater than 15 microns. By contrast, the coker quench stream, obtained from the centrifuge had a composition of 87.48% by weight water, 8.47% by weight solids and 4.05% by weight organics, the solids having a mean particle size of about 4 microns, and 90.25% of the total solids volume had a particle size of less than about 15 microns, the particle size distribution of the solids being generally Gaussian. Injection of this coker quench stream into the quench cycle of a typical delayed coking operation was found to reduce odors when deheading and cutting the coke as compared to odors experienced using the prior art process disclosed in U.S. Pat. No. 4,874,505. During a two-month period in 1992, about 74,372 barrels of feed containing about 44.7% oil and about 3.06% solids were processed, resulting in 35,385 barrels of clean recycled oil recovered to the refinery operation, and about 415 tons of solids contained in about 42,938 barrels of coker quench stream slurry successfully injected into the refinery cokers.

One of the primary advantages of the process of the present invention is that it greatly reduces the amount of valuable organics (oil) introduced into the delayed coker. This is accomplished while still achieving the desirable result of disposing of significant quantities of solids. The benefits that flow from this are numerous. For one, the oil that is recovered can be recycled to refinery operations for upgrading to much more valuable products rather than being adsorbed in the coke or otherwise lost in the coking process. The process, by recovering the oil (mobile organics) and altering the characteristics of the solids, i.e. as to particle size and particle size distribution, reduces variations in the composition of the coker quench stream fed to the quench cycle, which may reduce odors when deheading and cutting the coke, a result that has been noted in actual runs. Further, since the process of the present invention involves particle size reduction by attrition of the solids in the coker quench stream to the quench cycle, there is decreased plugging of the finished green coke, which is believed to cause hot spots during quenching and cooling and allows for a more homogenous dispersion of the solids throughout the coke. The process also results in lower VCM levels in the coke than can be achieved using the prior art process. The addition of coker quench stream can be conducted at lower temperatures without risking oily sludge build-up in the coke drum, a problem often encountered using the prior art process. Lastly, and importantly, the amount of solids disposed of per unit time can be increased. Since the duration of addition can also be increased, more solids can be disposed of.

The foregoing description and examples illustrate selected embodiments of the present invention. In light thereof, variations and modifications will be suggested to one skilled in the art, all of which are in the spirit and purview of this invention.

What is claimed is:

1. In a process for producing delayed petroleum coke, wherein a liquid hydrocarbon feed stream is introduced into a delayed coking vessel under delayed coking conditions and the coke produced is quenched, the improvement comprising:

treating a waste stream containing water, organic compounds and solids so as to cause attrition of said solids to produce a delayed coker quench stream containing from about 5 to about 35% by weight solids, water and less than about 6% by weight mobile organics, said solids in said coker quench stream having a particle size distribution such that greater than about 70% of the total solids volume comprises solids having a particle size of less than about 15 microns; and introducing said coker quench stream into said coking vessel during quenching.

2. The process of claim 1 wherein said solids in said coker quench stream have a mean particle size of less than about 10 microns.

3. The process of claim 1 wherein said solids in said coker quench stream have a particle size distribution that is generally Gaussian.

4. The process of claim 1 wherein said coker quench stream contains from about 5 to about 20% by weight solids and from about 2 to about 5% by weight mobile organics.

5. The process of claim 1 wherein treating of said waste stream comprises separating said waste stream in a high-speed vertical disk centrifuge.

6. A process for producing a delayed coker quench stream for use in producing delayed petroleum coke wherein a liquid hydrocarbon feed stream is introduced into a delayed coking vessel under delayed coking conditions and the coke produced is quenched comprising:

treating a waste stream containing water, organic compounds and solids so as to cause attrition of said solids to produce said delayed coker quench stream containing from about 5 to about 35% by weight solids, water and less than about 6% by weight mobile organics, said solids in said coker quench stream having a particle size distribution such that greater than about 70% of the total solids volume comprises solids having a particle size of less than about 15 microns.

7. The process of claim 6 wherein said solids in said coker quench stream have a mean particle size of less than about 10 microns.

8. The process of claim 6 wherein said solids in said coker quench stream have a particle size distribution that is generally Gaussian.

9. The process of claim 6 wherein said coker feed stream contains from about 10 to about 20% by weight solids and from about 2 to about 5% by weight mobile organics.

10. The process of claim 6 wherein treating of said waste stream comprises separating said waste stream in a high-speed disk centrifuge.

* * * * *